United States Patent [19]

Biffle

[11] 4,361,185

[45] Nov. 30, 1982

[54] STRIPPER RUBBER FOR ROTATING BLOWOUT PREVENTORS

[76] Inventor: John M. Biffle, Rte. 3, Box 445D, Midland, Tex. 79701

[21] Appl. No.: 202,686

[22] Filed: Oct. 31, 1980

[51] Int. Cl.[3] ..... E21B 33/03

[52] U.S. Cl. ..... 166/84; 166/88; 277/31; 175/195

[58] Field of Search ..... 277/2, 5, 31; 166/82, 166/84, 88; 175/195, 209, 210; 251/1 R, 1 A, 1 B

[56] References Cited

U.S. PATENT DOCUMENTS

| | | | |
|---|---|---|---|
| 2,746,781 | 5/1956 | Jones | 166/82 |
| 2,846,247 | 8/1958 | Davis | 166/84 X |
| 3,934,887 | 1/1976 | Biffle | 277/31 |

*Primary Examiner*—Ernest R. Purser
*Attorney, Agent, or Firm*—Marcus L. Bates

[57] ABSTRACT

An improved stripper rubber for a rotating blowout preventor. The stripper rubber has an upper annular area attached to the lower end of a metal support member. The support member extends upwardly into fixed relationship respective to part of the rotating head of a rotating blowout preventor. The stripper rubber downwardly depends into concentrically arranged, spaced annular body members. The inner annular body has an axial passageway formed therethrough for telescopingly receiving a rotating member in sealed relationship therewith. The outer annular member has an outer circumferentially extending wall surface which rotatably engages the lower marginal end of a washpipe. The inner and outer annular members are made integral respective to the stripper rubber, and are separated from one another by a downwardly opening annular recess. The annular recess is formed by a number of walls arranged to deflect debris flowing uphole, such that the debris impact against the wall surfaces and is deflected through the lateral outlet passageway of the rotating blowout preventor rather than impacting against any vital components thereof.

8 Claims, 4 Drawing Figures

STRIPPER RUBBER FOR ROTATING BLOWOUT PREVENTORS

BACKGROUND OF THE INVENTION

In U.S. Pat. Nos. 4,154,448 and 4,208,056, there is set forth a rotating blowout preventor, hereinafter called a RBOP, having a washpipe rigidly affixed to a main body, with there being a bearing housing located externally of the washpipe for rotatably supporting a rotating head assembly. The rotating head assembly includes a removable stripper rubber assembly which is received within the washpipe and is clamped at the upper end of the rotating head assembly. The stripper rubber assembly accordingly is easily removed from the remainder of the RBOP by merely unclamping the clamp means and lifting the unitary stripper rubber assembly from the interior of the washpipe.

The above construction isolates the bearing housing from the returned drilling fluid. However, debris flowing uphole impact against the annulus formed between the stripper rubber exterior and the washpipe interior. The debris continually and progressively accumulates and eventually the interior of the washpipe becomes unduly erroded. As this undesirable condition progresses, the debris eventually attack the rotating seal, accelerating the wear on the seal, until eventually the RBOP must be repaired. This condition is especially pronounced when drilling with compressible fluid such as air or gas because the debris can rebound several times as the drilling fluid changes direction to flow through the lateral outlet passageway.

Accordingly, it would be desirable to provide a RBOP with means by which the debris are deflected from an uphole axial direction into a lateral direction so that impact against the intervening area between the stripper rubber and the interior surface of the washpipe is procluded, thereby greatly reducing wear on the RBOP. Such an improvement is the subject of the present invention.

SUMMARY OF THE INVENTION

A RBOP having a main body, a lateral outlet leading from said main body, means for attaching the main body to the upper end of a wellbore casing, and an axial passageway formed through said main body through which a rotating member, such as a kelly or tool string, can be telescopingly received in sealed relationship therewith.

The main body includes an upwardly extending washpipe rigidly attached thereto and forming a support member for a rotating head assembly. The rotating head assembly is rotatably mounted at the upper end of the main body and includes a stripper rubber assembly which is telescopingly and rotatably received within the interior of the washpipe. The stripper rubber assembly includes a rotating seal which sealingly engages the interior of the washpipe, thereby precluding fluid flow through the annulus formed between the stripper rubber assembly and the washpipe.

The stripper rubber assembly includes an upper metal support member to which there is attached a stripper rubber at the lower end thereof. The before mentioned axial passageway is formed through the member and through the stripper rubber.

The stripper rubber has an upper end attached to the lower end of the member, with the lower end of the stripper rubber extending downwardly therefrom. The interior of the stripper rubber sealingly engages the rotating member which extends therethrough.

The stripper rubber has a large, upper annular end attached to the lower end of the member, and further includes spaced, concentrically arranged, lower annular ends.

The lower annular ends are made integrally with the upper end of the rubber and are comprised of an inner annular body and an outer annular body separated from one another by a downwardly opening annular recess. The inner annular body includes the before mentioned axial passageway while the outer annular body includes an outer circumferentially extending surface which rotatably engages the lower inside marginal end of the washpipe.

The annular recess includes an upwardly and outwardly inclined first wall which forms the lower outer marginal end of the inner annular body, an upwardly and inwardly inclined second wall which forms the lower outer marginal end of the outer annular body, and a sloped third wall which lies at an obtuse angle respective to the first wall and at an acute angle respective to the third wall. Debris flowing axially uphole intersect either the first, second, or third walls and ultimately is deflected in such a manner that the debris are forced to flow through the lateral outlet to thereby minimize the entrance of debris into the annular area between the washpipe and the stripper rubber assembly.

Accordingly, a primary object of the present invention is the provision of improvements in RBOP by which errosion at the annulus between the stripper rubber and the washpipe is minimized.

Another object of the present invention is the provision of an improved stripper rubber assembly having a stripper rubber made into a configuration which deflects axially uphole travel of debris laterally away from the interior thereof.

A further object of this invention is the provision of an improved stripper rubber for RBOPs which has a lower outer configuration for causing debris to be decelerated and deflected from an axial uphole direction into a lateral direction, thereby protecting the washpipe and seals from errosion.

A still further object of this invention is the provision of a RBOP having a stripper rubber assembly which forms part of the rotating head assembly, and which is made into a configuration to proclude wear of the coacting parts thereof.

Another and still further object of this invention is the provision of a stripper rubber assembly for a RBOP which is removably affixed to the rotating head of a RBOP, and which has a stripper rubber made into a particular configuration for decelerating and deflecting traveling debris from an uphole direction into a lateral direction so that the debris are deflected away from the washpipe and into the lateral outlet.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the present disclosure.

DETAILED DESCRIPTION OF THE PREFERRED EMBODIMENT

Figure 1:
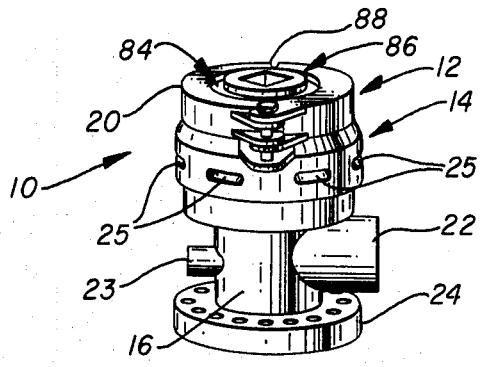
FIG. 1 PRIOR ART
FIG. 1 is a perspective view of a prior art RBOP within which a stripper rubber assembly of the present invention can be incorporated.
Figure 2:
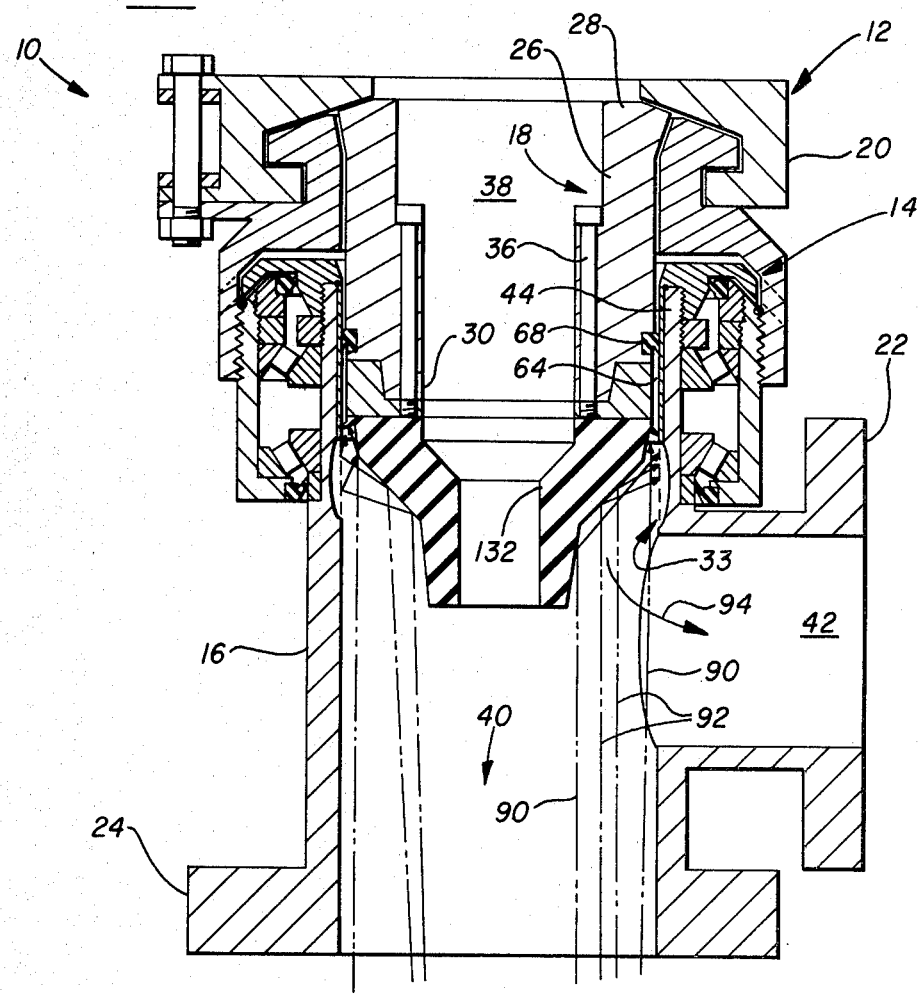
FIG. 2 PRIOR ART
FIG. 2 is an enlarged, diagrammatical, cross-sectional view of a prior art RBOP.

In FIGS. 1 and 2 of the drawings, there is disclosed a RBOP 10, which can take on several different forms, but which preferably has an external appearance made in accordance with U.S. Pat. Nos. 4,154,448 and 4,208,056. The RBOP includes a rotating head assembly 12 which is supported from a main body 16 by means of an external bearing housing 14.

In FIG. 2, there is disclosed some of the details of the prior art RBOP seen in FIG. 1. As seen in FIG. 2, the RBOP includes a removable stripper assembly 18 which is attached to the remaining parts of the rotating head assembly by the illustrated clamp 20.

An outlet 22 provides for lateral flow from the RBOP. An inlet flange 24 enables the entire RBOP to be removably attached to the upper end of a casing.

Figure 3:
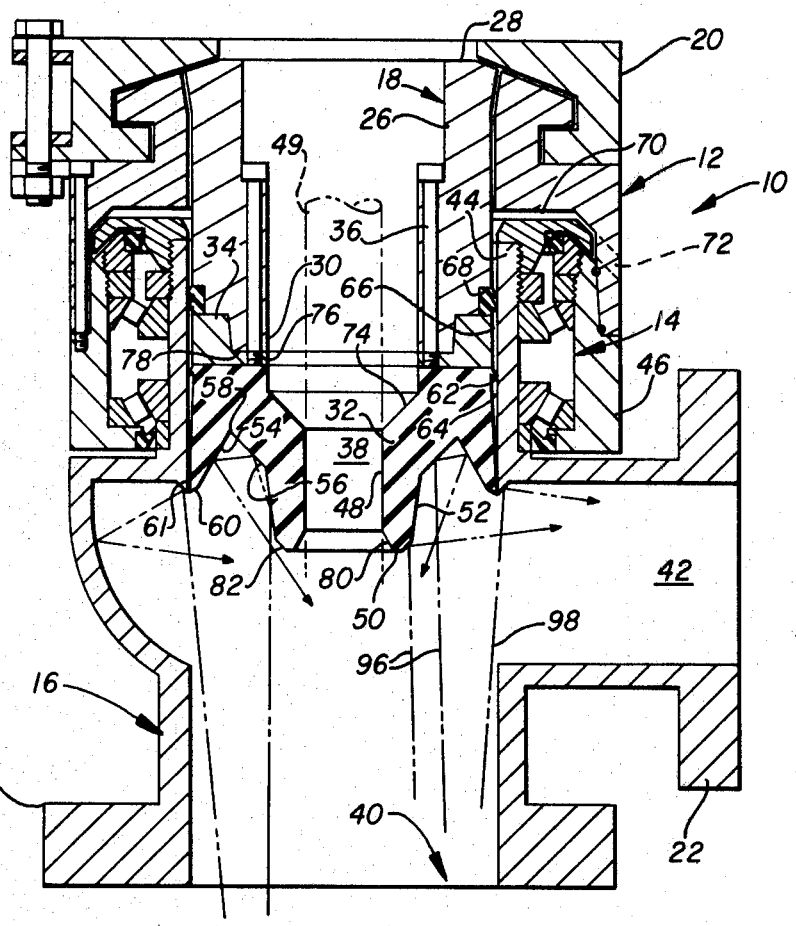
FIG. 3 is a longitudinal, cross-sectional view of an RBOP, such as seen in FIG. 2, having a stripper rubber made in accordance with the present invention; and, FIG. 4 is a detailed view of part of the apparatus disclosed in FIG. 3.
Figure 4:
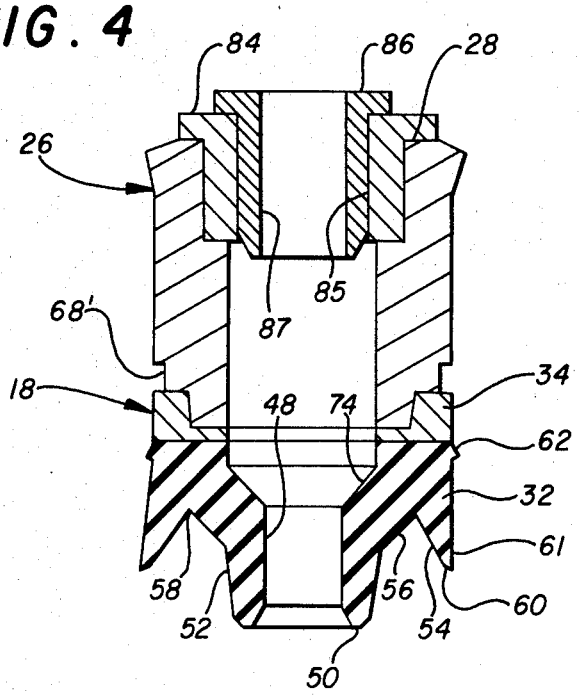

FIGS. 3 and 4 illustrate a stripper rubber assembly, made in accordance with the present invention, for use in conjunction with various different RBOPs, and especially the RBOP exemplified by the above recited patents. As seen in FIG. 3, the RBOP 10 includes the before mentioned rotating head assembly 12 and an external bearing housing 14 which rotatably journals the rotating head to the main body 16. The removable stripper assembly 18 is attached to the remainder of the rotating head by means of clamp 20, as in the before described manner.

The removably stripper assembly includes a mounting member 26, preferably made of steel, and having an upper end 28 which is removably held in axially aligned position by means of the before mentioned clamp. The mounting member terminates at the lower end 30, in attached relationship respective to a rubber stripper 32.

The rubber stripper includes an upper metal annular end 34 vulcanized to the rubber and having an upper attaching face made complementary respective to the lower end of the mount member. A circle of bolts 36 removably attach the stripper rubber apparatus to the stripper mount member. Axial passageway 38 extends through the mount member and stripper rubber, and hence, through the entire RBOP assembly. The arrow at numeral 40 generally indicates the downhole direction. Outlet 42 enables return flow from a downhole direction to occur to the mud pit.

Upper end 44 of the main body is in the form of a washpipe. Numeral 46 indicates the lower end of the exterior of the rotating head assembly.

The stripper rubber of this invention includes an innermost surface 48 which sealingly engages a rotating member 49 which may be telescopingly received in a slidable and sealed manner therethrough. The lowermost end 50 of the stripper rubber forms the lowermost terminal end of the stripper rubber assembly.

The stripper rubber includes a first sloped wall 52 which is spaced from a second sloped wall 54 by a third sloped wall 56. The second and third sloped walls meet at apex 58.

Accordingly, the upper marginal end of the stripper rubber is in the form of a relatively large annular member, while the lowermost marginal ends at 50 and 60 are in the form of concentrically arranged radially spaced annular members, with there being an outer annular member 60 and an inner annular member 50 separated from one another by a downwardly opening annular recess, wherein the recess is formed by the sloped wall portions 52, 54, and 56.

The lower marginal portion of the outermost wall 61 downwardly and outwardly slopes into slidable engagement respective to the inside peripheral lower wall surface of the washpipe. Circumferentially extending outwardly directed protuberance 62 forms a rotating barrier respective to a medial circumferentially extending wall portion of the washpipe, and separates isolated annulus 64 from annulus 66. Upper rotating seal 68 is attached to the mount member and forms a replaceable seal for preventing flow between annulus 66 and outlet annulus 70. Radially spaced apart bleed ports 72 form an outlet for egress of any material which may leak past the seals.

As seen in FIGS. 3 and 4, the stripper rubber is provided with an upwardly and outwardly sloped interior surface 74 which joins the axial passageway 48 with the large diameter passageway 76. The stripper rubber is stepped at 78 to provide the illustrated coacting surfaces which maintain the stripper rubber device properly aligned respective to the mount member. The marginal wall surface at the lowermost marginal end of the stripper rubber preferably is sloped at an angle as noted by numerals 80 and 82.

As seen in FIGS. 1 and 4, the RBOP can be provided with an adapter 84 so that various different kelly drive bushings 86 can be fitted to the upper inner marginal surface of the mount member, and accordingly, the upper inside walls of the member are contoured to accept the adapter, and the upper inside walls of the adapter are contoured to receive the kelly drive bushing, so that the kelly drives the bushing, the bushing drives the adapter, and the adapter drives the rotating head. Numeral 88 indicates a clamp fastener means (not shown) which is opposed to the illustrated clamp hinge.

In FIG. 2, it will be noted that debris at 90 and 92 flow axially uphole and impact against the lower marginal, exterior surfaces of the stripper rubber, where the debris are deflected away from the annulus 64, and accordingly, the illustrated configuration of the stripper rubber seen in FIGS. 3 and 4 decelerate and deflect the debris from an axial into a lateral path, so that the axially flowing debris is deflected laterally into passageway 42.

Moreover, it will be noted that the washpipe is protected by the outer annular member of the stripper rubber. The configuration of the stripper rubber exterior reduces the lower end of annulus 61 to practically nothing, so that it is almost impossible for debris to enter into the lower annulus at 61.

The entire stripper rubber assembly can be lifted from the interior of the rotating blowout preventor by loosening the clamp and lifting the mount member in an upward direction and onto the floor of a drilling rig. The rotating seal 68 and stripper rubber 32 can be rapidly replaced, whereupon the stripper rubber assembly can again be seated within the main body, the clamp fastened, and the rotating blowout preventor returned to service much faster than a prior art rotating blowout preventor can be unbolted from the top of the casing for servicing.

While the present invention has been disclosed in conjunction with a specific prior art rotating blowout preventor, it is contemplated to use the stripper rubber and washpipe combination in other types of rotating blowout preventors.

I claim:

1. A rotating blowout preventor having a main body; a lateral outlet leading from said main body, means for attaching said main body to the upper end of a wellbore casing; an axial passageway formed through said main body through which a rotating member can be telescopingly received;

an upwardly extending washpipe affixed to and forming part of said main body; a rotating head assembly rotatably mounted at the upper end of said main body, said rotating head assembly includes a stripper rubber assembly affixed to said rotating head assembly and positioned within said axial passageway; said stripper rubber assembly includes a stripper mount member and a stripper rubber for sealingly engaging the washpipe; an axial passageway formed through said stripper rubber assembly;

said stripper rubber has an upper end attached to said mount member and a lower end extending downwardly therefrom for sealingly engaging a rotating member which may extend axially therethrough;

said stripper rubber having a large annular upper end attached to said mount member, and spaced, concentrically arranged, lower annular marginal ends;

said lower annular marginal ends are comprised of an inner annular body and an outer annular body separated from one another by a downwardly opening annular recess;

said inner annular body has an axial passageway formed therethrough for sealingly engaging a rotating member;

said outer annular body has an outer circumferentially extending surface which slidably engages the lower inside marginal end of the washpipe; said outer circumferentially extending surface of said annular body outwardly diverges to sealingly bear against the lower marginal interior surface of the washpipe, said annular body and said washpipe have a lower edge portion which jointly terminate to provide a sealed interface therebetween;

said annular recess includes an upwardly and outwardly inclined first wall which forms the lower outer marginal end of said inner annular body, an upwardly and inwardly inclined second wall which forms the lower inner marginal end of said outer annular body, and a sloped third wall which lies at an obtuse angle respective to said first wall and at an acute angle respective to said third wall so that debris which intersects either of said first, second, and third wall surfaces are deflected in such a manner to minimize the entrace thereof into the annulus formed between the stripper rubber assembly and the washpipe.

2. The rotating blowout preventor of claim 1 wherein said first wall surface is inclined at a small angle respective to the central axis of the stripper assembly, and said second wall surface is inclined at a greater angle relative to the first wall.

3. The rotating blowout preventor of claim 1 wherein said rotating head assembly is rotatably mounted to said main body by journal means located externally of said washpipe, with the rotating assembly extending above said washpipe; a seat formed at the upper marginal end of said rotating assembly, the upper marginal end of said stripper assembly being received by said seat; said clamp means circumferentially extends about and holds the upper marginal end of said mount member to the remaining part of the rotating head assembly.

4. The rotating blowout preventor of claim 1 wherein said rotating head assembly is rotatably mounted to said main body by journal means located externally of said washpipe, with the rotating head assembly extending above said washpipe; a seat formed at the upper marginal end of said rotating head assembly, the upper marginal end of said stripper assembly being received by said seat; said clamp means circumferentially extends about and holds the upper marginal end of said mount member to the remaining part of the rotating head assembly.

5. in a rotating blowout preventor having a main body which includes a mounting flange at the lower end thereof and a lateral outlet at a sidewall thereof, an upstanding washpipe having an annular seal surface on the interior thereof, a rotating head assembly rotatably mounted respective to said main body; the combination with said rotating head assembly of a stripper assembly;

said stripper assembly includes a metal mount member having a stripper rubber attached to the lower end thereof, a rotating seal means affixed to said stripper assembly for sealingly engaging the seal surface of the washpipe, an axial passageway formed through said main body and stripper assembly through which a rotating member can be received;

said stripper rubber having a large annular upper end attached to said mount member, and concentrically arranged, spaced, lower marginal annular ends;

said lower annular ends are comprised of an inner annular body and an outer annular body made integral with respect to said large annular end and separated from one another by a downwardly opening annular recess;

said inner annular body has an axial passageway formed therethrough for sealingly engaging a rotating member;

said outer annular member has an outer circumferentially extending surface which outwardly diverges and sealingly engages the lower inside marginal end of the washpipe; the lower marginal end of said outer annular body and said washpipe jointly terminate at the same elevation to provide a rotating barrier at the interface therebetween;

said annular recess includes an upwardly and outwardly inclined first wall which forms the lower outer marginal end of said inner annular body, an upwardly and inwardly inclined second wall which forms the lower inner marginal end of said outer annular body, and a sloped third wall which lies at an obtuse angle respective to said first wall and at an acute angle respective to said third wall so that debris which intersects either of said first, second, and third wall surfaces are deflected in such a manner to minimize the entrance thereof into the annulus formed between the stripper rubber assembly and the washpipe.

6. The combination of claim 5 wherein said first wall surface is inclined at a small angle respective to the central axis of the stripper assembly, and said second wall surface is inclined at a greater angle relative to the first wall.

7. The combination of claim 5 wherein said rotating head assembly is rotatably mounted to said main body by journal means located externally of said washpipe, with the rotating assembly extending above said washpipe; a seat formed within the upper marginal end of said rotating assembly, the outer upper marginal end of said stripper assembly being received on said seat; said clamp means circumferentially extends about and holds the upper marginal end of said mount member to the remaining part of the rotating head assembly.

8. The combination of claim 5 wherein said rotating head assembly is rotatably mounted to said main body by journal means located externally of said washpipe, with the rotating assembly extending above said washpipe; a seat formed at the upper marginal end of said rotating assembly, the upper marginal end of said stripper assembly being received by said seat; said clamp means circumferentially extending about and holding the upper marginal end of said doughnut to the rotating head assembly.

* * * * *